United States Patent [19]

Izumiya et al.

[11] Patent Number: 4,742,269

[45] Date of Patent: May 3, 1988

[54] CERAMIC ENVELOPE DEVICE FOR HIGH-PRESSURE DISCHARGE LAMP

[75] Inventors: Hirotsugu Izumiya; Mikio Kariya, both of Nagoya, Japan

[73] Assignee: NGK Insulators, Ltd., Japan

[21] Appl. No.: 794,767

[22] Filed: Nov. 4, 1985

[30] Foreign Application Priority Data

Nov. 9, 1984 [JP] Japan ..... 59-170662[U]
Jul. 5, 1985 [JP] Japan ..... 60-103313[U]
Jul. 5, 1985 [JP] Japan ..... 60-103314[U]

[51] Int. Cl.[4] ..... H01J 61/073; H01J 61/36

[52] U.S. Cl. ..... 313/624; 313/625; 313/631

[58] Field of Search ..... 313/624, 625, 623, 631, 313/632

[56] References Cited

U.S. PATENT DOCUMENTS 2,731,581 1/1956 Krefft ..... 313/631 X
3,892,993 7/1975 Timmermans ..... 313/623 X
4,376,905 3/1983 Kerekes ..... 313/623 X
4,507,584 3/1985 Coaton et al. ..... 313/624
4,531,074 7/1985 Nagy et al. ..... 313/623 X
4,539,511 9/1985 Denbigh et al. ..... 313/624
4,585,972 1/1986 Hing ..... 313/624 X

*Primary Examiner*—Palmer C. DeMeo
*Attorney, Agent, or Firm*—Parkhurst & Oliff

[57] ABSTRACT

A ceramic envelope device for a high-pressure metal-vapor discharge lamp, including a translucent ceramic tube, a pair of electrically conducting end caps closing opposite open ends of the ceramic tube, a pair of oppositely located discharge electrodes each of which is supported at one end thereof by an inner hole in the corresponding end cap, and a pair of power-supply lead members each of which is supported at one end thereof by an outer hole in the corresponding end cap. A space or radial gap is formed between at least a portion of an outer surface of the electrodes and lead members and their respective supporting holes. At least one of the electrodes and the lead members is formed from a twisted wire consisting of a plurality of metallic strands. The electric resistance of each end cap may fall within a range of 0.1–5 Ω. The end caps may be covered at their inner surface with an electrically insulating member which has a tubular protruding portion surrounding a part of the corresponding electrode which protrudes from a radially central portion of the inner surface of the corresponding end cap.

18 Claims, 2 Drawing Sheets

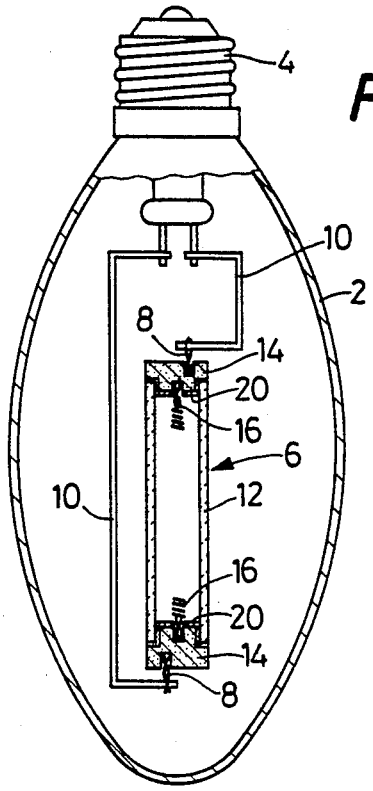
FIG. 1
FIG. 2
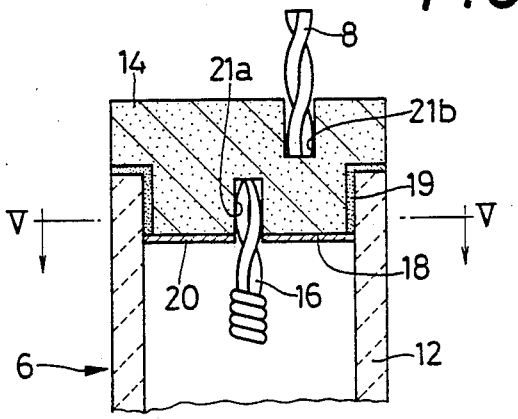

CERAMIC ENVELOPE DEVICE FOR HIGH-PRESSURE DISCHARGE LAMP

BACKGROUND OF THE INVENTION

The present invention relates in general to a ceramic envelope device for use in a high-pressure discharge lamp (hereinafter referred to as "HID lamp"; "HID" representing High Intensity Discharge) having a pair of closure discs in the form of electrically conducting end caps which close the opposite open ends of a translucent ceramic arc tube to form a gas-tight envelope. More particularly, the invention relates to an arc-discharging electrode and an electric-power lead member which are fixed to one of the opposite sides of each closure disc and to the other side of the same, respectively.

In the art of such HID lamps using a translucent ceramic tube, a pair of electrically conducting discs are known as end caps to close the opposite open ends of the translucent ceramic tube. Examples of such closure end caps are illustrated in U.S. Pat. Nos. 4,155,757 and 4,155,758. Such end caps are formed of an electrically conducting cermet obtained by mixing, for example, particles of tungsten with particles of aluminum oxide, and sintering the mixture. The electrically conducting cermet end caps support a pair of tungsten electrodes at their inner surfaces in the interior of the ceramic envelope, so that the electrodes protrude from the inner surfaces of the end caps toward each other, i.e., longitudinally inwardly in the translucent ceramic tube. Additionally power-supply lead rods or contact rods are connected or fixed to the outer surfaces of the cermet end caps by suitable methods, so that electric power is applied to the pair of opposed tungsten electrodes through the contact rods and through the cermet end caps. Such cermet end caps have been advantageously employed, for example, in high-pressure sodium lamps, because they eliminate the need of using expensive metallic niobium. It is further recognized that such cermet end caps have been used also advantageously for so-called metal halide lamps which employ translucent ceramic tubes charged with a suitable metal halide together with mercury and rare gas, because the cermet exhibits relatively high corrosion resistance to metal halides.

However, such cermet end cap has a tendency to crack due to an excessive shrinkage of its green body in a sintering process in which an electrode and a power-supply lead member are partially embedded in the cermet end cap. The cermet end cap is also apt to crack due to too large a difference in thermal expansion between the material thereof and that of the electrode and lead member. Such cracks in turn cause the translucent ceramic tube to leak and thereby lower the degree of its luminous flux. When these problems become severe, the HID lamp will fail to function.

SUMMARY OF THE INVENTION

The present invention, which was made in view of the above-discussed inconveniences experienced in the prior art, has as its principal object the provision of a ceramic envelope device for a high-pressure metal-vapor discharge lamp, which avoids not only cracking of the end caps but also leaking of the translucent ceramic tube.

According to the instant invention, there is provided a ceramic envelope device for use in a high-pressure discharge lamp, including a translucent ceramic tube, a pair of electrically conducting end caps closing opposite ends of the ceramic tube, a pair of opposed discharge electrodes each of which is supported at its one end by the corresponding end cap such that the other end of the electrode protrudes from an inner surface of the corresponding end cap in a longitudinally inward direction in the ceramic tube, and a pair of electric-power lead members each of which is supported at its one end by the corresponding end cap such that the other end of the lead member protrudes outwardly from an outer surface of the corresponding end cap, characterized in that at least one of the electrode and the lead member on at least one of said end caps is formed of a twisted wire which consists of a plurality of metallic strands.

In the ceramic envelope device of the high-pressure discharge lamp according to the invention, the end cap is advantageously protected against cracking because the electrode and/or the lead member which are (is) partially embedded in the end cap are (is) formed of a twisted wire or stranded conductor. Such electrode and/or lead member of twisted-wire type will contribute to improvement in the operating reliability of the lamp. Furthermore, the prevention of the aforementioned trouble by this type of electrode and/or lead members results in avoiding leakage from the translucent ceramic tube and thereby maintaining a high degree of its luminous flux.

In accordance with one embodiment of the invention, the twisted wire is made, for example, by twisting two to four strands. Each strand for the twisted wire may have a diameter of 0.2–0.7 mm. The twisted wire may have a pitch of 3–10 mm (The "pitch" means an axial length of the twisted wire that is needed for one full turn of the strands). The twisted wire may be embedded at its one end in a hole formed in the corresponding end cap, which hole may have a circular cross-sectional shape. A length of embedded part of the twisted wire may be determined to be not less than 1.5 mm.

According to another embodiment of the invention, the above-identified at least one end cap has an electric resistance of 0.1–5 Ω. The electric resistance of the at least one end cap may be held within a range of 0.1–0.6 Ω, in particular.

In the above-discussed embodiment, the at least one end cap is effectively protected against cracking in a manufacturing process and during use. The high-pressure metal-vapor discharge lamp not only obtains an improved operating reliability but also has a better performance in starting to light, maintains for a longer amount of time a high degree of luminous flux and renders an excellent color for lighting.

According to yet another embodiment, each of the end caps is covered at its inner surface with an electrically insulating member. The electrically insulating member may have, for the at least one end cap, a protruding portion surrounding a part of the corresponding electrode which protrudes from a radially central part of the inner surface of the corresponding end cap. In this connection, the above-identified part of the corresponding electrode may be radially spaced a predetermined distance from the electrically insulating member. The predetermined distance may be held to be not more than a half of a radius of the end caps, more preferably within a range of 0.1–2 mm.

In the above embodiment, the electrically insulating member covering the inner surface of the corresponding end cap will effectively protect the ceramic envelope device against not only cracking of the end cap in manufacture and during use but also an "arc-back" phenomenon which occurs between the electrode and the corresponding end cap at the moment when the lamp is turned on. Furthermore, the end cap can be protected against corrosion due to the liquid metal halide of the metal halide lamp when the lamp is on.

According to a further embodiment of the invention, the electrically insulating member is made of a refractory ceramic material selected from the group consisting of alumina, beryllia, spinel, boron nitride and glass frit. Above all, it is recommended that the electrically insulating member is made of white and opaque alumina.

In a still further embodiment of the invention, the electrically insulating member has an annular peripheral portion of a constant thickness, as measured from the inner surface of the corresponding end cap. In this case, the thickness of the annular peripheral portion is preferably held within a range of 0.05–0.8 mm.

According to a yet further embodiment of the invention, the protruding portion has a thickness of 1.0–3 mm, as measured from the inner surface of the corresponding end cap. The protruding portion may be of a tubular shape, defining therein a central bore through which the corresponding electrode extends. The protruding portion may have a variable-diameter part which has a thickness increasing progressively in a radially inward direction toward the central bore, as measured from the inner surface of the corresponding end cap. Furthermore, the protruding portion may have a secondary protruding portion which contacts a central part of the corresponding end cap and protrudes into the central bore, while the secondary protruding portion is radially spaced from the corresponding electrode.

According to an also further embodiment of the invention, the electrically insulating member has a substantially frusto-conical shape, having a central bore through which the corresponding electrode extends with a radial gap therebetween.

BRIEF DESCRIPTION OF THE DRAWINGS

The foregoing and other objects, features and advantages of the invention will be apparent from reading the following detailed description of illustrative embodiments taken in conjunction with the accompanying drawings, in which:

FIG. 1 is a schematic elevational view partly in cross section of an example of a HID lamp incorporating one embodiment of a ceramic envelope device of the invention which includes a pair of electrodes and lead members of twisted-wire type which are embedded in electrically conducting cermet end caps closing the opposite ends of a translucent ceramic tube;

FIG. 2 is a fragmentary view partly in longitudinal section, showing in enlargement one end portion of the envelope device of the HID lamp of FIG. 1;

DETAILED DESCRIPTION OF THE PREFERRED EMBODIMENTS

Figure 3:
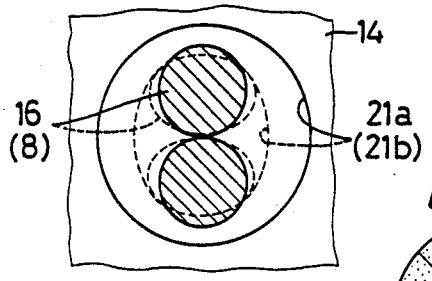
FIG. 3 is a cross-sectional view, showing relationships between an electrode and an end cap before and after a shrinkage fit of the electrode in the end cap, wherein full lines represent the relationship before the shrinkage fit and broken lines represent the relationship after the shrinkage fit.

To further clarify the present invention, preferred embodiments of the invention will be described in detail with reference to the accompanying drawings.

Referring first to FIG. 1, there is schematically illustrated an complete assembly of a HID lamp which incorporates one preferred embodiment of a ceramic envelope device 6 of the invention which will be described. In the figure, reference numeral 2 designates a bulbiform translucent jacket which is generally made of glass or a similar material. This translucent jacket 2 is closed at its open end by a base 4. The jacket 2 and the base 4 cooperate to form a gas-tight enclosure which is charged with a suitable inert gas such as nitrogen, or maintained under vacuum. As is well known in the art, electric power applied to the base 4 is supplied, via electrical conductor members 10, 10, to electrically conducting lead members 8, 8 which are disposed at the opposite ends of the ceramic envelope device 6 accommodated in the translucent jacket 2.

The ceramic envelope device 6 includes a translucent ceramic arc tube 12 and a pair of closure discs in the form of end caps 14, 14 which are secured to the opposite ends of the ceramic arc tube 12 so as to maintain gas-tightness of the ceramic envelope 6. The translucent ceramic arc tube 12 is a tubular member made of alumina or some other ceramic material as disclosed in U.S. Pat. Nos. 3,026,210 and 3,792,142. The end caps 14, 14 are formed from an electrically conducting material. Each of the lead members 8, 8 is embedded at its one end in an outer portion of the corresponding end caps 14, 14. On the other hand, a pair of discharge electrodes 16, 16 are embedded at their one end in an inner portion of the corresponding end caps 14, 14. The ceramic arc tube 12 of the gas-tight ceramic envelope device 6 is charged with a suitable gas, and a suitable metal or compound of said metal which are selected depending upon the specific type of HID lamp, from the standpoints of radiant efficiency, color-rendering properties, etc. In the case of a high-pressure sodium lamp, for example, the arc tube 12 is charged with metallic sodium, mercury and rare gas. In a metal halide lamp, the arc tube 12 is charged with a metal halide (such as dysprosium iodide, thallium iodide, sodium iodide, indium iodide, etc.), together with mercury and rare gas.

One aspect of the invention is related to the electrodes 16, 16 and the lead members 8, 8 which are partially embedded in the electrically conducting end caps 14, 14 closing the opposite ends of the translucent ceramic arc tube 12.

Figure 5:
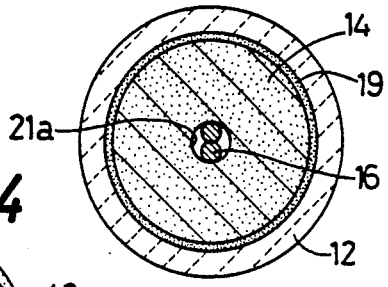
FIG. 5 is a cross-sectional view taken along line V—V of FIG. 2.

As illustrated in FIG. 2 on an enlarged scale, each electrically conducting end cap 14 is fixedly fitted in one end of the translucent ceramic arc tube 12 of the ceramic envelope device 6, with the help of a sealing layer 19 made of a glass-frit or a similar material. The end cap 14 may be fitted in the arc tube 12 by means of a shrinkage fit without using a sealing member like the sealing layer 19. Each electrode 16 is formed of a twisted or stranded wire which consists of two strands, and is embedded at its one end in an inner hole 21*a* formed in the inner portion of the end cap 14, such that the other end of the twisted-wire type electrode 16 protrudes from an inner surface 18 of the end cap 14 in a longitudinally inward direction in the translucent arc tube 12. Moreover, the corresponding lead member 8 also consists of two strands, and is similarly embedded at its one end in an outer hole 21*b* formed in the outer portion of the end cap 14, such that the other end of the lead member 8 protrudes outwardly from the end cap 14. The electrode 16 and lead member 8 of twisted-wire type are made of tungsten a similar material. The inner hole 21*a* and the outer hole 21*b* have a circular cross sectional shape (as shown in FIG. 5). The inner hole 21*a* and the twisted-wire electrode 16 are positioned at a radially central portion of the end cap 14 (the arc tube 12). The inner surface 18 from which the electrode 16 protrudes is covered with an electrical insulator (electrically insulating member) 20 for preventing an "arc-back" phenomenon which is an undesirable electrical discharge between the electrode 16 and the corresponding inner surface 18 upon application of a voltage. The inner surface 18 may be covered, wholly or partly, with the insulator 20.

Referring to FIG. 3, when the twisted-wire electrode 16 (the twisted-wire lead member 8) is partly embedded in the inner hole 21*a* (the outer hole 21*b*) by shrinkage in a sintering process at a high temperature, each of the end cap 14 and the electrode 16 (the lead member 8) undergoes thermal deformation in cross section as indicated by the broken lines. The thermal deformation absorbs or reduces thermal stresses between the end cap 14 and the corresponding electrode 16 (the lead member 8), while assuring a good electrical contact therebetween and a sufficiently tight fit of the electrode 16 and the lead member 8 in the end cap 14.

Figure 4:
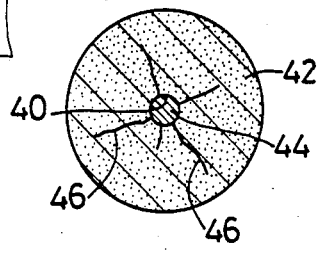
FIG. 4 is a cross-sectional view illustrating cracking in an end cap in which a conventional rod type electrode is embedded.

Referring to FIG. 4, a conventional rod type electrode 44 completely fills a hole 40 formed in an end cap 42. In this case, thermal stresses in the end cap 42, which occur during a sintering process, are not effectively absorbed, so that the end cap 42 will suffer cracks 46, 46 or other problems.

Referring to FIG. 5, the stranded or twisted-wire type electrode 16 fixed to the end cap 14 according to the present invention does not completely fill the inner hole 21*a*. That is, a space or gap exists in the inner hole 21*a*, even after the twisted-wire electrode 16 is embedded therein. As a result, the electrode 16 can be transformed, so that the shrinkage stress of the end cap 14 may be advantageously released or relaxed.

While a conventional HID lamp employs a metallic rod of 0.4–1.5 mm diameter for its electrode (lead member), the instant ceramic envelope device 6 uses the twisted-wire electrode 16 (lead member 8), which may consist of two to four strands or wires made of tungsten, which have a diameter of 0.2–0.7 mm. In this connection, it is recommended that a twisting pitch of the twisted wire be held within a range of 3–10 mm (wherein, the "pitch" means an axial length of the twisted wire that is required for one full turn of its strands). Furthermore, the length of embedded part of the electrode 16 (the lead member 8) is preferably determined to be not less than 1.5 mm. When the number of strands used for a twisted wire is increased, or as the pitch of the twisted wire is decreased, the periphery of the embedded part of the electrode 16 (the lead member 8) is closer to the inner surface defining the inner hole 21*a* (the outer hole 21*b*), and the effects of the above-mentioned thermal transformation on reduction of the thermal stress are accordingly reduced. On the other hand, an electrode which consists of a plurality of straight metallic wires has some effects on absorption of the thermal stress, but such electrode is hard to embed in the end cap 14 because of the lack of unity of its strands.

The ceramic envelope device 6 constructed according to the invention is protected against cracking in the end cap 14 and consequent leaking thereof, which have been experienced in conventional lamp due to an excessive difference in thermal expansion between an end cap and each of an electrode and a lead member of a rod type. Hence, the ceramic envelope 6 has ameliorated problems such as a lowered degree of luminous flux and a failure to light.

Another aspect of the invention relates to the end cap 14 in which the twisted-wire type electrode 16 and lead member 8 are embedded.

In the illustrated embodiment constructed as described hitherto, an electric resistance of the end cap 14 as a closure member for the translucent ceramic tube 12 is determined to be within a range of 0.1–5 Ω. That is, the material and dimensions for the end cap 14 are suitably determined so as to meet the above-indicated requirement of electric resistance.

The reason why the material and dimensions of the end cap 14 are so limited is as follows. If the electric resistance of the end cap 14 is below 0.1 Ω, the end cap generates only a small amount of heat, so that such end cap 14 has a relatively small amount of contribution to a good starting and an excellent color-rendering of the lamp. Such end cap 14 will not leak because of only a small difference in thermal expansion between the end cap 14 and the tungsten electrode 16. Hence, an application of the present invention to the ceramic envelope device 6 is not economically advantageous.

On the other hand, if the resistance of the end cap 14 exceeds 5 Ω, the end cap 14 causes a waste of electric power, reducing the economical efficiency of the lamp. In addition, the thermal stress between the end cap 14 and each of the electrode 16 and the lead member 8 becomes so intense that the end cap 14 might crack.

For a metal halide lamp which employs metal halide gas as a high-pressure metal-vapor, the electric resistance of the end cap 14 is preferably within a range of 0.1–0.6 Ω. This is because, if the resistance exceeds 0.6 Ω, the end cap 14 will generate an excessive amount of heat and suffer corrosion by heated metal halide, in some cases depending upon the nature and amount of the metal halide.

The material of the electrically conductiong end cap 14 is selected from any suitable material, in view of its dimensions, as long as its specific resistance meets the aforementioned requirement of its electric resistance. With the end cap 14 dimensioned to suit an intended lamp, it is recommended to use a material having a specific resistance of $1.0\times10^{-2}$ to $1.0\times10^{2}$ Ω·cm.

From a standpoint of thermal expansion, it is recommended that the end cap 14 is formed from an electrically conducting cermet material having a coefficient of thermal expansion which falls between that of the material forming the translucent ceramic arc tube 12, and that of the refractory metal of the electrode 16 and the lead member 8. For example, a composite material consisting of metallic tungsten or metallic molybdenum and aluminum oxide, or tungsten carbide or tungsten boride may be used for the end cap 14. In particular, it is recommended to use a cermet which is a composite material of a non-metallic material and a metal which has a variable refractoriness (heat resistance), corrosion resistance, thermal expansion coefficient and electric resistance by changing its composition. Preferably, the cermet consists of 8–50% by weight of refractory metal such as tungsten or molybdenum, and the balance being aluminum oxide. The cermet containing not more than 8% by weight of a metallic material is excessively high in electric resistance, while the cermet containing the same in an amount exceeding 50% by weight can not be a sufficiently densified body, and renders the end cap 14 poor in gastightness.

Although it is the most preferable that both of the twisted-wire type electrode 16 and lead member 8 are formed from a twisted or stranded wire as previously indicated. The object of the invention may be accomplished to some extent, even if only one of the two members 16, 8 is formed of a twisted wire.

The end cap 14 provided with the twisted-wire electrode 16 and lead member 8 as described hitherto is suitably applicable to a translucent ceramic arc tube (12) used in HID lamps such as metal halide lamps and high-pressure sodium lamps.

Table I shows results of the test which was conducted on HID lamps according to the invention and on comparative samples. The HID lamps were repeatedly turned on and off 1,000 times, with a 250 W alumina arc tube. The samples of the invention tested used different forms of the electrodes 16 and lead members 8, and the end caps 14 having different values of electric resistance. As indicated in the table, the samples according to the invention demonstrated better results (less leakage problems) than the comparative samples.

The end caps 14, electrodes 16, lead members 8, and electrical insulators 20 of the samples of the invention have the following specifications:

Electrically conducting end caps 14:
- Diameter—5 mm
- Thickness—5 mm

Electrodes 16 and Lead members 8:
- Material—tungsten
- Twisted-wire type;
  - Diameter of a metallic strand—0.3 mm
  - Number of metallic strands—2
  - Pitch of twisted wire—3 mm
- Rod type;
  - Diameter of a rod—0.6 mm Electrical insulators 20:
- Material—alumina
- Thickness—0.3 mm Length of embedded part of the electrode 16 and the lead member 8; 1.5 mm Distance between the electrode 16 and the lead member 8; 2 mm

TABLE I

| SAMPLE NO. | | ELECTRODES AND LEAD MEMBERS | COMPOSITION *1 W POWDER (wt. %) | COMPOSITION *1 $Al_2O_3$ PARTICLES (wt. %) | ELECTRIC RESISTANCE (Ω) | CALORIE EMITTED BY END CAPS (J/sec) | OCCURRENCE OF LEAK-TROUBLE |
|---|---|---|---|---|---|---|---|
| PRESENT INVENTION | 1 | TWISTED-WIRE | 15 | 85 | 0.1 | 0.4 | – |
| | 2 | " | 14.7 | 85.3 | 0.6 | 2.4 | – |
| | 3 | " | 14.5 | 85.5 | 2 | 8 | – |
| | 4 | " | 13 | 87 | 5 | 20 | – |
| COMPARATIVE | 5 | " | 16 | 84 | 0.05 | 0.2 | – |
| | 6 | " | 12 | 88 | 10 | 40 | + |
| | 7 | ROD | 14.5 | 85.5 | 2 | 8 | + |

*1 SIZE OF W POWDER: 0.5 μm; $Al_2O_3$ PARTICLE SIZE: 44–210 μm

Figure 6:
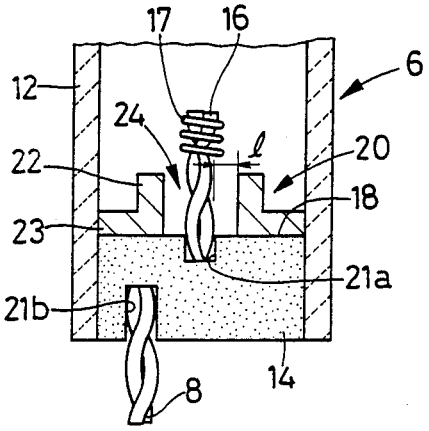
FIG. 6 is a sectional view corresponding to FIG. 2, illustrating another embodiment of the invention.

Referring to FIG. 6, there is shown another embodiment of the invention, wherein the inner surface 18 from which the electrode 16 protrudes is covered with the electrical insulator 20, except for the central portion thereof around the fixed end of the electrode 16. In this modified embodiment, at least the electrical insulator 20 for the lower end cap 14 (the lower one when the lamp is oriented upright as shown in FIG. 1) has a central protruding portion 22 of a tubular shape which protrudes, longitudinally inwardly of in the ceramic arc tube 12, so as to surround a longitudinally intermediate part of the centrally located discharge electrode 16 which protrudes from the inner surface 18 of the corresponding (lower) end cap 14. Stated more specifically, the central protruding portion 22 protrudes from an annular peripheral portion 23 of the electrical insulator 20, and has a thickness larger than that of the peripheral portion 23 of a constant thickness, as measured from the inner surface 18 of the end cap 14. The discharge electrode 16, which is embedded over a suitable length in the central portion of the corresponding end cap 14, extends through a central bore 24 defined by the protruding portion 22 while being spaced a predetermined distance from the protruding portion 22 (the electrical insulator 20).

In the ceramic envelope device 6 described above, the electrical insulator 20 which has the central protruding portion 22 formed with the central bore 24 and covers the inner surface 18 of the end cap 14 is effective to prevent an "arc-back" phenomenon which is an electrical discharge between the electrode 16 and the inner surface 18 upon application of a voltage between the opposed electrodes 16, 16 through the lead members 8, 8 at the moment when the HID lamp is turned on.

Therefore, the electrical insulators 20, 20 permit normal arcing between the opposed ends of the discharge electrodes 16, 16, making it possible to prevent the conventionally experienced problems of cracking and consequent leaking at the end caps 14, 14 due to the "arc-back" phenomenon, and to avoid vaporization and scattering of refractory metal of the cermet end caps 14, 14. Accordingly, the electrical insulators 20, 20 are capable of solving the conventionally encountered problem of blackening of the inner surface of the translucent arc tube 12 due to deposition of the refractory metal, and thereby overcoming the resulting problem of reduced luminous flux of the arc tube 12.

When the lamp is on, the central bore 24 (more particularly, the predetermined distance between the electrode 16 and the inner surface of the protruding portion 22 of the electrical insulator 20) effectively cuts off thermal conduction of the heated electrode 16, so as to keep at a comparatively low temperature the liquid phase of supersaturated metal halide condensed around the inner surface of the peripheral portion 23 of the electrical insulator 20, and thereby inhibit the reactivity of the liquid metal halide. The liquid metal halide around the central bore 24 is gasified due to the high-temperature electrode 16, and the gasified metal halide is condensed in the cold spot spaced from the electrode 16, i.e., the peripheral portion of the ceramic arc tube 12. As a result, the central portions of both the end cap 14 and the electrical insulator 20 around the electrode 16 are advantageously protected against corrosion by the liquid metal halide. Hence, the life span of the lamp is prolonged.

The central protruding portion 22 of the electrical insulator 20 keeps the liquid phase of metal halide condensed in the vicinity of the end cap 14, away from the exposed end portion of the discharge electrode 16, whereby the central portion of the cermet end cap 14 around the fixed end of the electrode 16 is protected against exposure to the liquid metal halide and consequent corrosion thereof. Hence, the conventional failure of the end cap 14 to stably support the electrode 16 is effectively avoided.

On the other hand, even though the thermal expansion properties of the electrical insulator 20 (e.g., alumina) may not match that of the electrode 16 (e.g., tungsten, molybdenum), the fact will not cause the electrical insulator 20 to crack or suffer similar problems in a manufacturing process. This is because there exists a distance between the electrode 16 and the inner surface of the protruding portion 22.

The electrical insulator 20 provided to cover the inner surface 18 of the end cap 14 is made of any suitable electrically insulating material, preferably refractory and electrically insulating ceramics having a thermal expansion coefficient close to that of the material of the end cap 14. For example, the electrical insulator 20 is made of alumina, beryllia, spinel, boron nitride, or glass frit. In particular, it is recommended to use a white and opaque alumina, because this material advantageously reflects radiant heat of the electrode 16 and thereby maintains the liquid phase of supersaturated metal halide at a lower temperature than other meterials. This insulator 20 is formed by a suitable known process. For instance, it is molded and sintered, whether simultaneously as an integral part of the end cap 14 or separately from that. It may be formed by applying a coating of a selected insulating material to the pre-sintered material of the end cap 14, by a printing method or a spraying method.

Figure 7:
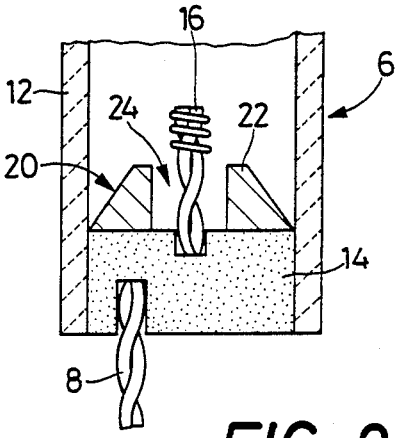
FIGS. 7–9 are sectional views corresponding to FIG. 6, respectively, illustrating further embodiments of the invention.

In accordance with the present invention, at least one of the electrical insulators 20, 20 should be provided with the protruding portion 22 protruding along a longitudinal axis of the electrode 16 and surrounding a part of the electrode 16. While the central protruding portion 22 of FIG. 6 is provided as a stepped portion which protrudes from the annular peripheral portion 23 of the electrical insulator 20, it is possible that the electrical insulator 20 be formed as shown in FIG. 7, wherein the protruding portion 22 has a variable-diameter part which has a thickness increasing in a radially inward direction toward the central bore 24, as measured from the inner surface 18 of the end cap 14. In other words, the diameter of the variable-diameter part of the protruding portion 22 decreases as it protrudes from the inner surface 18. Alternatively, the electric insulator 20 may be made in the form of substantially frusto-conical shape, provided therein with the central bore 24.

While at least the inner surface 18 of the end cap 14 must be covered with the electrical insulator 20 according to the invention, it is possible to cover all surfaces of the end cap 14 with the electrical insulator 20. The thickness of the peripheral portion 23 of the electrical insulator 20 of FIG. 6 is selected within an appropriate range so as to effectively restrain the "arc-back" phenomenon, generally within an approximate range of 0.05–0.8 mm. On the other hand, the thickness of the central protruding portion 22 surrounding the longitudinally intermediate part of the electrode 16 is determined to fall within a range of 1.0–3 mm, in order to protect the exposed portion of the electrode 16 against exposure to the condensed metal halide, and to thereby protect the central portion of the end cap 14 around the fixed end of the electrode 16. However, the thickness of the central protruding portion 22 should be determined so that the top of the protruding portion 22 will not contact a coil 17 wound on the exposed portion of the electrode 16.

The diameter of the central bore 24 is selected so that the electrode 16 and the protruding portion 22 of the electrical insulator 20 do not contact each other. To this end, a distance l between the two is determined to be not more than ½ a radius of the end cap 14, more preferably, within a range of 1.0–2 mm.

Figure 8:
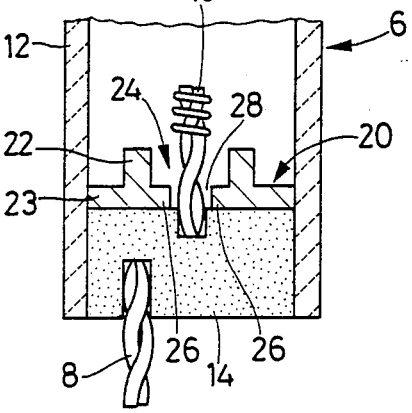

The central bore 24 defined by the protruding portion 22 of the electrical insulator 20 avoids more effectively the arc-back phenomenon if the insulator 20 is provided with a secondary protruding portion 26, as shown in FIG. 8. The secondary protruding portion 26 contacts an annular central part of the corresponding end cap 14 and protrudes from a part of the inner surface of the protruding portion 22 (the electrical insulator 20) into the central bore 24. In this case, the secondary protruding portion 26 defines therein a secondary central bore 28 and is radially spaced a shorter distance from the corresponding electrode 16 than the distance l.

With the protruding portion 22 provided for surrounding the corresponding part of the electrode 16, neighboring part of the twisted-wire electrode 16 has a larger thermal capacity, whereby the electrode 16 becomes hard to be heated and thereby emits less thermoelectrons. As a result, the lamp has a disadvantage in its starting performance of lighting. However, the end cap 14 with an electric resistance determined within the previously-indicated range eliminates such problems. That is, the end cap 14 having such resistance preferably heats the electrode 16, assuring a good starting of the lamp.

The end cap 14 supporting the twisted-wire electrode and lead member 16, 8 and covered with the electrical insulator 20, as described hitherto, serves advantageously to tightly close the translucent ceramic tube 12 used in the HID lamps such as the metal halide lamps and the high-pressure sodium lamps. In particular, it is preferably used for the metal halide lamps.

Figure 9:
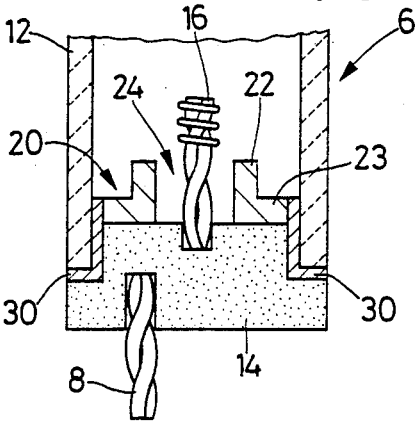

While the end caps 14 of FIGS. 6, 7 and 8 are secured to the ceramic arc tube 12 by a shrinkage-fitting method utilizing a shrinkage difference between the two during a sintering process, it will be obvious that the end cap 14 may be fixed to the ceramic tube 12 with the help of a sealing layer 30 of glass frit or the like, as illustrated in FIG. 9.

Table II shows results of the test which was conducted on HID lamps according to the invention and on comparative samples. The HID lamps were repeatedly turned on and off 1,000 times, with a 250 W alumina arc tube. The samples of the invention tested used different forms of the electrodes 16 and lead members 8, and the end caps 14 having different values of electric resistance. As indicated in the table, the samples according to the invention demonstrated better results (less leakage problems) than the comparative samples.

The end caps 14, electrodes 16, lead members 8, and electical insulators 20 of the samples of the invention have the following specifications:

Electrically conducting end caps 14:
- Diameter—5 mm
- Thickness—5 mm

Electrodes 16 and Lead members 8:
- Material—tungsten
- Twisted-wire type;
  - Diameter of a metallic strand—0.3 mm
  - Number of metallic strands—2
  - Pitch of twisted wire—3 mm
- Rod type;
- Diameter of a rod—0.6 mm Electrical insulators 20:
- Material—alumina
- Thickness—0.3 mm Length of embedded part of the electrode 16 and the lead member 8; 1.5 mm Distance between the electrode 16 and the lead member 8; 2 mm Thickness of the protruding portion 22; 3 mm Radial thickness of the protruding portion 22; 0.5 mm Distance l between the electrode 16 and the electrical insulator 20; 0.2 mm

TABLE II

| SAMPLE NO. | ELECTRODES AND LEAD MEMBERS | COMPOSITION *1 W POWDER (wt. %) | COMPOSITION *1 $Al_2O_3$ PARTICLES (wt. %) | ELECTRIC RESISTANCE (Ω) | CALORIE EMITTED BY END CAPS (J/sec) | OCCURRENCE OF LEAK-TROUBLE | STARTING OF LAMP |
|---|---|---|---|---|---|---|---|
| PRESENT INVENTION | | | | | | | |
| 1 | TWISTED-WIRE | 15 | 85 | 0.1 | 0.4 | – | SATISFACTORY |
| 2 | " | 14.7 | 85.3 | 0.6 | 2.4 | – | " |
| 3 | " | 14.5 | 85.5 | 2 | 8 | – | " |
| 4 | " | 13 | 87 | 5 | 20 | – | " |
| COMPARATIVE | | | | | | | |
| 5 | " | 16 | 84 | 0.05 | 0.2 | – | UNSATISFACTORY |
| 6 | " | 12 | 88 | 10 | 40 | + | SATISFACTORY |
| 7 | ROD | 14.5 | 85.5 | 2 | 8 | + | " |

*1 SIZE OF W POWDER: 0.5 μm; $Al_2O_3$ PARTICLE SIZE: 44–210 μm

While the present invention has been illustrated in its preferred embodiments, it is to be understood that the invention is not limited by the details of description of construction and arrangement, and that it is intended to cover all changes, modifications and improvements which are obvious to those skilled in the art, and which do not affect the spirit of the invention nor exceed the scope thereof as expressed in the appended claims.

What is claimed is:

1. A ceramic envelope device for a high-pressure metal vapor discharge lamp, comprising:

a translucent ceramic tube;

a pair of electrically conducting end caps having an inner surface and an outer surface and closing opposite ends of the ceramic tube, each of said end caps having an inner hole extending from said inner surface toward said outer surface and an outer hole extending from said outer surface toward said inner surface;

a pair of discharge electrodes, wherein at least one of said pair of discharge electrodes comprises a plurality of metallic strands, wherein each of said metallic strands has a diameter of 0.2–0.7 mm, said strands being twisted together to form a twisted wire, wherein said twisted wire has a pitch of 3–10 mm, said electrodes having a first end and a second end, said first end of at least one of said discharge electrodes being supported by said inner holes of each end cap and fixed therein by shrinkage of said end cap during sintering thereof, such that said second end of said at least one of said discharge electrodes protrudes from the inner surface of each corresponding end cap in a longitudinally inward direction in the ceramic tube; and a pair of electric-power lead members, wherein at least one of said pair of lead members comprises a plurality of metallic strands, wherein each of said metallic strands has a diameter of 0.2–0.7 mm, said strands being twisted together to form a twisted wire, wherein said twisted wire has a pitch of 3–10 mm, said lead members having a first end and a second end, said first end of at least one of said lead members being supported by said outer holes of each end cap and fixed therein by shrinkage of said end cap during sintering thereof, such that said second end of said at least one of said lead members protrudes outwardly from the outer surface of each corresponding end cap, wherein a plurality of radial spaces exists between at least a portion of an outer surface of said at least one of said discharge electrodes and an inner surface of said inner holes and a plurality of radial spaces exists between at least a portion of an outer surface of said at least one of said lead members and an inner surface of said outer holes.

2. A ceramic envelope device as claimed in claim 1, wherein said twisted wire is embedded in the inner and outer holes a length of not less than 1.5 mm.

3. A ceramic envelope device as claimed in claim 1, wherein said twisted wire consists of 2 to 4 metallic strands.

4. A ceramic envelope device as claimed in claim 1, wherein each of said end caps has an electric resistance of 0.1–5 Ω.

5. A ceramic envelope device as claimed in claim 4, wherein each of said end caps has an electric resistance of 0.1–0.6 Ω.

6. A ceramic envelope device as claimed in claim 1, wherein said inner and outer holes have a cross sectional shape which is circular prior to sintering of each corresponding end cap.

7. A ceramic envelope device for a high-pressure metal-vapor discharge lamp, comprising:

a translucent ceramic tube;

a pair of electrically conducting end caps having an inner surface and an outer surface and closing opposite ends of the ceramic tube, each of said end caps having an inner hole extending from said inner surface toward said outer surface and an outer hole extending from said outer surface toward said inner surface, said inner surface of each of said end caps being covered with an electrically insulating member, said electrically insulating member including a protruding portion which surrounds a part of each discharge electrode protruding from a radially central portion of the inner surface of each end cap, said part of the corresponding electrode being radially spaced a predetermined distance from said electrically insulating member;

a pair of discharge electrodes, wherein at least one of said pair of discharge electrodes comprises a plurality of metallic strands, wherein each of said metallic strands has a diameter of 0.2–0.7 mm, said strands being twisted together to form a twisted wire, wherein said twisted wire has a pitch of 3–10 mm, said electrodes having a first end and a second end, said first end of at least one of said discharge electrodes being supported by said inner holes of each end cap and fixed therein by shrinkage of said end cap during sintering thereof, such that said second end of said at least one of said discharge electrodes protrudes from the inner surface of each corresponding end cap in a longitudinally inward direction in the ceramic tube; and a pair of electric-power lead members, wherein at least one of said pair of lead members comprises a plurality of metallic strands, wherein each of said metallic strands has a diameter of 0.2–0.7 mm, said strands being twisted together to form a twisted wire, wherein said twisted wire has a pitch of 3–10 mm, said lead members having a first end and a second end, said first end of at least one of said lead members being supported by said outer holes of each end cap and fixed therein by shrinkage of said end cap during sintering thereof, such that said second end of said at least one of said lead members protrudes outwardly from the outer surface of each corresponding end cap, wherein a plurality of radial spaces exists between at least a portion of an outer surface of said at least one of said discharge electrodes and an inner surface of said inner holes and a plurality of radial spaces exists between at least a portion of an outer surface of said at least one of said lead members and an inner surface of said outer holes.

8. A ceramic envelope device as claimed in claim 7, wherein said electrically insulating member comprises a refractory ceramic material selected from the group consisting of alumina, beryllia, spinel, boron nitride, and glass frit.

9. A ceramic envelope device as claimed in claim 8, wherein said alumina is selected from the group consisting of white and opaque alumina.

10. A ceramic envelope device as claimed in claim 7, wherein said protruding portion has a thickness of 1.0–3 mm, as measured from the inner surface of each corresponding end cap.

11. A ceramic envelope device as claimed in claim 7, wherein said protruding portion comprises a tubular shape, having a central bore therein, through which each corresponding discharge electrode extends.

12. A ceramic envelope device as claimed in claim 7, wherein said predetermined distance is not greater than half of a radius of said end caps.

13. A ceramic envelope device as claimed in claim 12, wherein said predetermined distance is within a range of 0.1–2 mm.

14. A ceramic envelope device as claimed in claim 7, wherein said protruding portion includes a variable-diameter portion which has a thickness which increases progressively in a radially inward direction toward said central bore, as measured from the inner surface of each corresponding end cap.

15. A ceramic envelope device as claimed in claim 7, wherein said electrically insulating member includes an annular peripheral portion having a constant thickness from which said protruding portion protrudes.

16. A ceramic envelope device as claimed in claim 15, wherein said annular peripheral portion has a thickness of 0.05–0.8 mm as measured from the inner surface of each corresponding end cap.

17. A ceramic envelope device as claimed in claim 7, wherein said electrically insulating member comprises a substantially frusto-conical shape, having a central bore through which each corresponding electrode extends, such that a radial gap is formed between the insulating member and each corresponding electrode therebetween.

18. A ceramic envelope device as claimed in claim 7, wherein said electrically insulating member includes a secondary protruding portion which contacts a central part of each corresponding end cap, and protrudes into said central bore, said secondary protruding portion being radially spaced apart from each corresponding electrode.

* * * * *